United States Patent [19]

Sterenberg

[11] Patent Number: 4,942,994

[45] Date of Patent: Jul. 24, 1990

[54] SKI BOOT HOLDER

[76] Inventor: Lawrence D. Sterenberg, R.R. #4 P.O. Box 325, Marshall, Ill. 62441

[21] Appl. No.: 232,279

[22] Filed: Aug. 15, 1988

[51] Int. Cl.[5] ..... A45F 5/00

[52] U.S. Cl. ..... 224/247; 224/250; 224/917; 294/166

[58] Field of Search ..... 224/247, 250, 254, 255, 224/270, 272, 917; 294/143, 147, 162, 166; 36/132; 12/120.5; 211/134, 137, 138; 223/120

[56] References Cited

U.S. PATENT DOCUMENTS

| | | | |
|---|---|---|---|
| 2,566,656 | 9/1951 | David | 12/120.5 |
| 2,883,688 | 4/1959 | Barreca | 12/120.5 |
| 3,248,027 | 4/1966 | Pfleider | 294/143 X |
| 3,412,866 | 11/1968 | Binding | 294/162 |
| 3,497,891 | 3/1970 | Vöster et al. | 294/162 X |
| 3,600,734 | 8/1971 | Pollinger | 12/120.5 |
| 3,721,373 | 3/1973 | Penniman | 294/143 |
| 3,747,774 | 7/1973 | Kulik | 211/37 |
| 3,794,226 | 2/1974 | Penniman | 294/162 |
| 3,802,572 | 4/1974 | Shackel | 211/38 |
| 4,248,365 | 2/1981 | Jacobs | 294/143 |
| 4,277,006 | 7/1981 | Pinckard | 294/145 |
| 4,629,103 | 12/1986 | Miller | 224/250 |
| 4,733,897 | 3/1988 | Schuetzeberg | 294/162 |
| 4,779,362 | 10/1988 | Citrowske | 36/132 |

*Primary Examiner*—Henry J. Recla
*Assistant Examiner*—R. M. Fetsuga
*Attorney, Agent, or Firm*—Howard J. Barnett

[57] ABSTRACT

A ski boot holder which comprises a collapsible handle attached to a heel frame which is connected to elastic toe retaining means. The toe retaining means may include a toe retaining frame, which helps to hold the boots in proper alignment in the holder. The heel frame and toe frame may be designed to collapse for easy and compact storage, or carrying in the skier's pocket when the ski boot holder is not in use. A collapsible carrying handle is provided which extends upwardly between the ankle portions of the ski boots so that the boots are conveniently carried with the soles horizontally disposed. This orientation of the boots facilitates the storage of the assembly under an airplane seat, on a shelf at a ski lodge, or on a closet floor. The carrying unit is stable and compact, and no special display racks are required in ski shops which employ the subject ski boot holders in their boots, because the ski boots are held in compact units which can be placed on the floor, on display shelves, or even hung by the carrying handles to make an effective display.

10 Claims, 2 Drawing Sheets

SKI BOOT HOLDER

BACKGROUND OF THE INVENTION

1. Field of the Invention

This invention is directed to a ski boot holder which comprises a collapsible handle attached to a heel frame, which is connected to elastic toe retaining means. The toe retaining means may include a toe frame which helps to hold the boots in proper alignment in the holder. The heel frame and toe frame may be designed to collapse for easy carrying in the skier's pocket when not in use on the ski boots.

2. Description of the Prior Art

U.S. Pat. No. 3,964,117 issued to Fox shows a device for holding boots in an upright position with the boot soles in a generally horizontal plane, but Fox's device is intended for high-heeled cowboy boots, and it is a bulky device, not really intended to be used as a boot carrier (no carrying handle is shown). The main purpose of the Fox device is to aid in the removal of high topped cowboy boots, and to hold the soles in shape while drying so that the toes do not curl.

Voster et al, U.S. Pat. No. 3,497,891, also shows boots held side by side on a generally U-shaped frame, and the boots may be exhibited or stored with the soles resting flat on the floor, or with the soles extending upright. This Voster et al device could not be considered collapsible in the sense that the subject ski boot holder is capable of being folded to even smaller dimensions so that it can easily be carried in the skier's pocket when the boots are being worn for skiing. Voster et al's handle is disposed at the toe end of the boots. The sliding frame rails of Voster et al's device clamp the boots in position, and they are locked there by means of a resilient tongue which is urged against a row of serrations.

Other patents directed to ski boot holders are listed below:

| U.S. Pat. No. | Inventor | Date |
|---|---|---|
| 3,210,787 | Allsop I | 1965 |
| 3,237,226 | Gjesdahl | 1966 |
| 3,397,416 | Celli | 1968 |
| 3,441,967 | Salzman | 1969 |
| 3,729,760 | Allsop II | 1973 |
| 3,737,933 | Wunder | 1973 |
| 4,160,301 | Woolley | 1979 |

None of these latter patents shows the side-by-side (boot soles horizontal) alignment made possible with the subject invention. Most of these earlier patents show a pre-occupation with clamping and holding the toes of the ski boots to prevent curling. Such clamping is not required with the more recently developed plastic ski boots, which hold their shape indefinitely even when subjected to wet conditions.

The above U.S. patents are all directed to boot holders which are more complicated to make, and which are more complicated to use. None of the above patents shows a collapsible ski boot holder which can be made into a pocket-size package when not in use, and which holds the boots in an upright position for easy transport while traveling to and from the ski slopes. The subject ski boot holder keeps the boots in a neat, compact unit which is easy to carry using the handle which extends upward between the backs of the boots.

SUMMARY OF THE INVENTION

This invention provides a collapsible and simple ski boot holder which is easy to make and is less complicated than the prior devices used for this purpose. The first embodiment of the invention comprises a rigid heel frame adapted to fit around the back of the heels of a pair of ski boots. The outer ends of the heel frame are each connected to the corresponding ends of an elastic toe retainer strap which extends around the front of the toes of the ski boots to hold them in fixed relationship to each other with the boots soles disposed in a generally horizontal plane.

A flexible carrying handle is secured at the mid-point of the heel frame, and it extends upwardly between the boots at the back. A slidable retainer clip is provided on the flexible carrying handle which slides down to engage the respective ankle straps of the boots. A hand grip on the outer end of the carrying handle facilitates carrying of the ski boots.

The second embodiment includes a rigid toe frame interconnected to the heel frame by a pair of elastic members. A carrying handle is pivotally attached to the heel frame. Both of the above embodiments can be designed to be collapsible so that the device can be folded and carried in the pocket.

DESCRIPTION OF THE PREFERRED EMBODIMENTS

Figure 3:
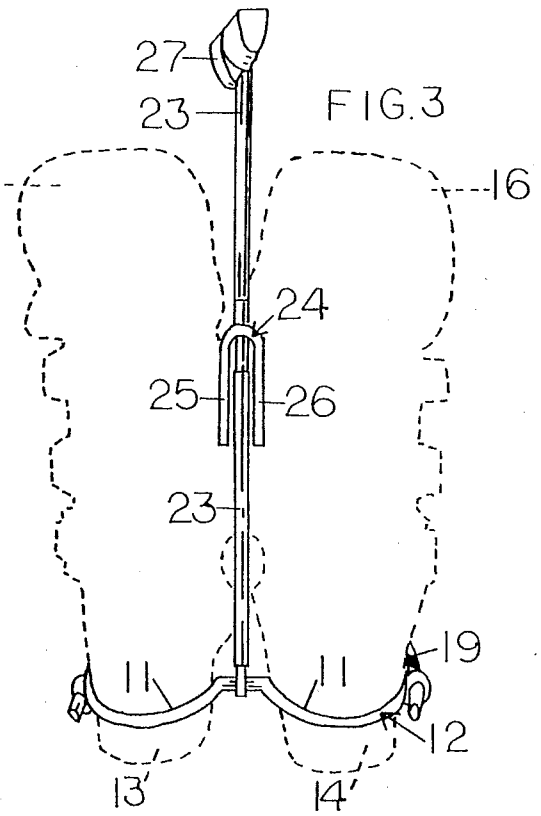
FIG. 3 is a back view of FIG. 2 to show how the slidable retainer clip slides down to engage the respective ankle straps of the boots.
Figure 2:
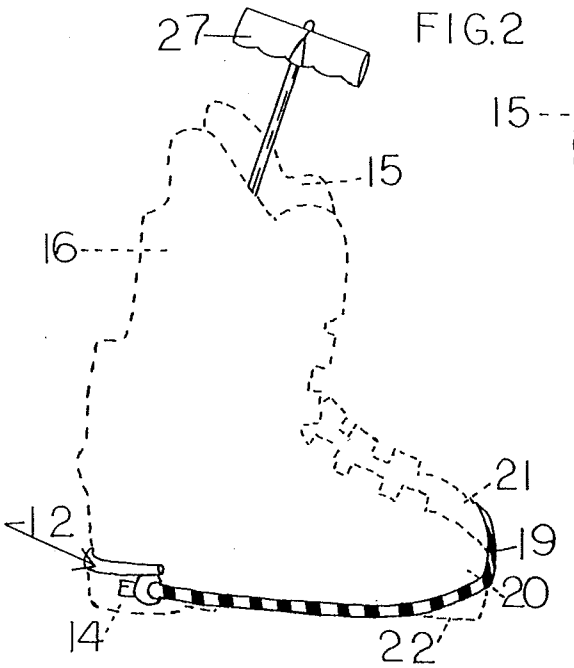
FIG. 2 is a side view of the holder shown in FIG. 1, assembled on a pair of ski boots, which are shown in outline, only.

As shown in the drawings, the ski boot holder 10 includes a pair of arched, bow-like portions which define a rigid heel frame 12 which is adapted to fit around the back of the heels 13 and 14 of a pair of ski boots 15 and 16. The respective eye-like clamp ends 17 and 18 of the heel frame 12 engage and firmly hold the corresponding ends of an elastic toe retainer strap 19. The toe retainer strap 19 is stretched around the front of the toes 20 and 21 of the ski boots 15 and 16 to hold the boots 15 and 16 in fixed relationship to each other with the boot soles 22 disposed in generally horizontal plane, so that the assembly can be conveniently placed on a floor, for example, under an airplane seat, or on a shelf in a ski lodge closet, or a display rack in a ski shop.

A flexible carrying handle 23 is secured at the midpoint of the heel frame 12, and extends upwardly and vertically between the boots 15 and 16 at the back, as best shown in FIG. 3. A slidable retainer clip 24 is provided on the flexible carrying handle 23. The retainer clip 24 slides down the handle 23 to engage the respective ankle straps 25 and 26 of the boots 15 and 16 as best seen in FIG. 3, to hold the tops of the boots 15 and 16 together in a stable and compact unit.

The outer end of the flexible carrying handle 23 is provided with a hand grip 27 to facilitate carrying of the assembled boots 15 and 16 while traveling to and from the ski slopes. Since the boots and holder define a neat, unitary and stable assembly, they can be conveniently placed on the floor under an airplane seat, in a trunk of a motor vehicle, or even placed on the ground in the snow, because the boots are oriented in an upright, side-by-side position, and snow will not usually go over the tops. Also, because of the upright position, extra socks can be carried in the boots, or other sporting paraphernalia such as sunscreen, goggles and ski mitts.

Figure 1:
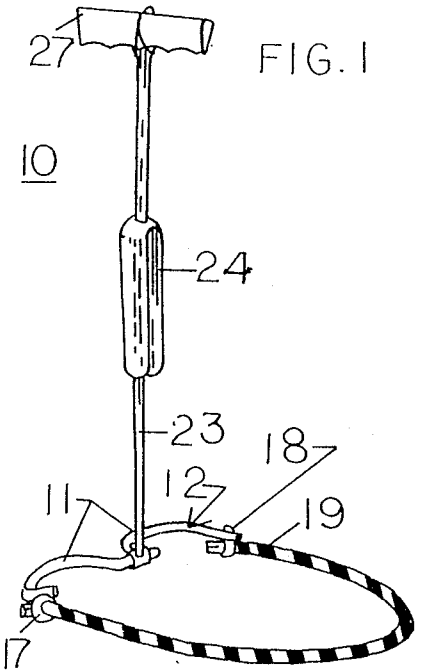
FIG. 1 of the drawings is ¾ perspective view of the first embodiment of the ski boot holder showing the parts oriented in approximately the same position as when in use.
Figure 4:
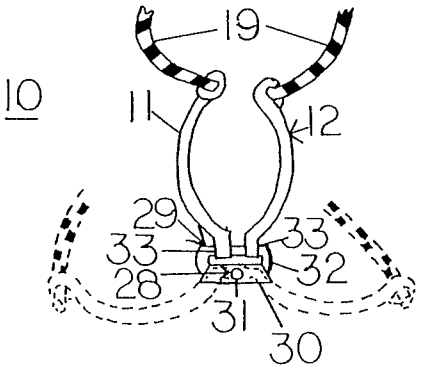
FIG. 4 is a detail of the heel frame to illustrate how it may be hinged to facilitate collapsibility or storage.

As can best be seen in FIG. 4, the ski boot holder 10 of FIG. 1 can be collapsed into a compact package when removed from the boots at the ski area. The compact package can be conveniently carried in the skier's pocket until it is again used on the boots after skiing.

To make the ski boot holder 10 even more compact, the bow-like portions 11 can be connected at their midpoint 28 by hinge assembly 29 which allows the heel frame 12 to be folded together into an even smaller package. The hinge assembly 29 includes a half sleeve-like member 30 which cradles the back central portions of the bow-like portions 11 of the holder 10 to maintain rigid contact between the bow-like portions 11 and the heels 13 and 14 of the ski boots 15 and 16 during use.

As shown in FIG. 4, the half sleeve-like member 30, is provided with a vertical pin 31, which extends through a semi-circular connecting ring 32, which holds the inner ends 33 of the bow-like portions 11 of the heel frame 12, and through the sleeve-like member 30 to provide a collapsible heel frame 12, but which is rigidly supported by the sleeve-like member 30 when in use on a pair of ski boots.

Figure 6:
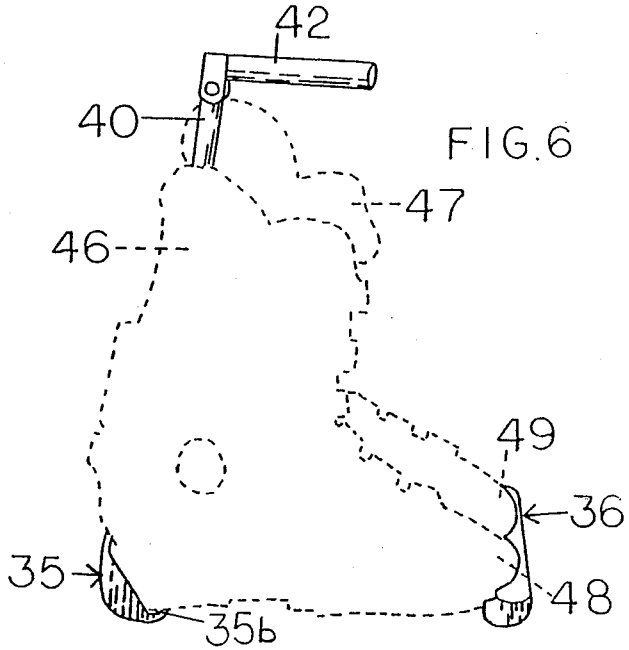
FIG. 6 is a side view from a slightly elevated position of the holder shown in FIG. 5 with the heels and toe frames in place on the heels and toes of a pair of ski boots shown in outline.
Figure 5:
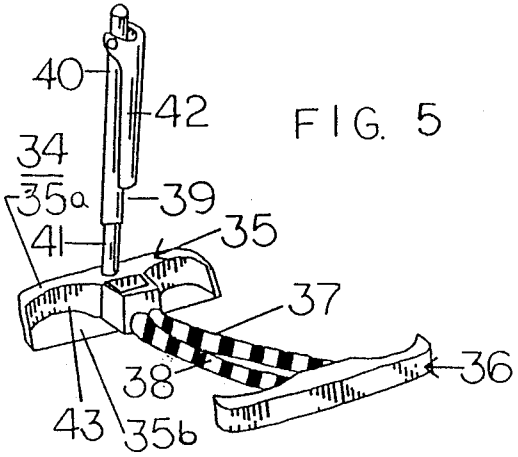
FIG. 5 is a ¾ view of the second embodiment of the ski boot holder showing the parts oriented in approximately the same position as when in use, but with the telescoping handle compressed, and the handle grip folded down.

FIGS. 5–8 of the drawings show another embodiment of the ski boot holder of the invention which has some common features and some different features compared with the ski boot holder 10 shown in FIGS. 1–4. As seen in FIG. 5, a ski boot holder 34 includes a rigid heel frame 35 and a rigid toe frame 36 which are interconnected by means of elastic cord members 37 and 38. Rigid heel frame 35 includes an upper lip portion 35*a* and a lower lip portion 35*b* which are contoured to fit closely around the projecting heel portions 44 and 45 of the ski boots 46 and 47. A telescoping handle 39 extends vertically upward from the middle of the heel frame 35. The telescoping handle 39 comprises at least two tubular sections 40 and 41, which may be collapsed together when the ski boot holder 34 is not in use. A foldable handle grip 42 is provided on the top of the section 40 of the handle 39. As can be seen in FIGS. 5 and 6, the handle grip 42 can be pivoted from a compact, folded position to a convenient horizontal carrying position.

The inner sides 43 of the heel frame 35 are contoured to conform to the outer shape of the backs of the heels 44 and 45 of a pair of ski boots 46 and 47 shown in outline in FIGS. 5 and 6. The toe frame 36 is also contoured on the inside surface thereof to conform to the shape of the toes 48 and 49 of the ski boots 46 and 47. As best seen in FIG. 5, the heel frame 35 is connected to the toe frame 36 by means of elastic cord members 37 and 38, which are short enough to require some stretching to mount the ski boot holder 34 on a pair of ski boots 46 and 47.

Figure 7:
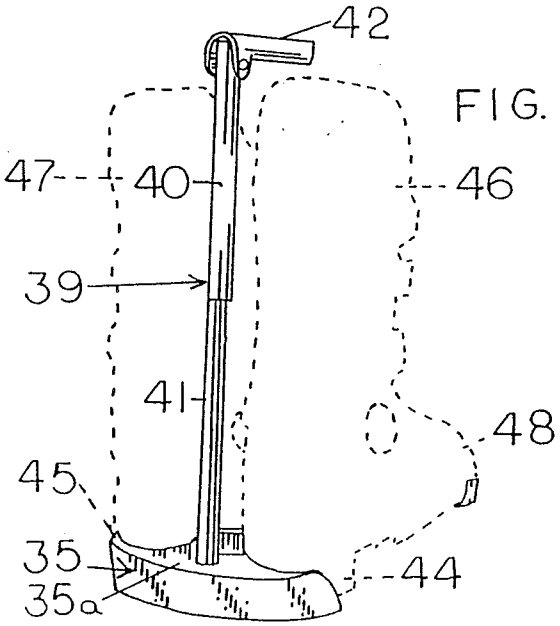
FIG. 7 is a back view of FIG. 6 to show how the carrying handle extends up between the heels of the boots.

As can best be seen in FIGS. 6 and 7, the carrying handle 39 extends vertically upward between the boots 46 and 47 when the holder 34 is in use. The stretching of the elastic cord members 37 and 38 is sufficient to urge the heel frame 35 and the toe frame 36 firmly against the toes 48 and 49 and heels 44 and 45 of the ski boots 46 and 47, respectively, to define a compact carrying and storing unit for the newest type of ski boots, which have fibre glass or plastic shells. These new boots are designed with the required flexibility, but do not warp, so the ski boot holder 34 need not have a sole clamping effect as disclosed in earlier ski boot holders of the prior art.

Figure 8:
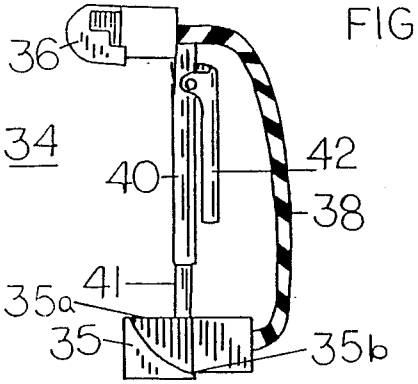
FIG. 8 is a detailed side view of the ski boot holder of FIG. 5 to illustrate how it may be hinged to facilitate collapsibility for storage.

FIG. 8 of the drawings shows how the ski boot holder 34 may be collapsed into a compact package when not in use on the ski boots 46 and 47. The handle grip 42 is folded down against carrying handle 39, and the section 40 of handle 39 is telescoped down over section 41. The toe frame 36 is then pulled over the outer end of carrying handle 39 by stretching the elastic cord members 37 and 38, which then urge the toe frame 36 against the carrying handle 39 to form a compact package. Although not shown in FIG. 8, the toe frame 36 and the heel frame 35 can be made with hinges to collapse toward each other, making an even more compact package, similar to that described above in connection with FIG. 4.

The ski boot holder of the subject invention is considerably simpler than the prior devices described above. Not only does it simplify the assembly and disassembly steps, it greatly facilitates carrying the ski boots to and from the ski slopes, whether traveling by bus, auto, plane or train. The generally horizontal disposition of the soles of the boots make it easy to set the boots down on a floor or the ground, and to pick them up again. The boot and holder unit is stable and compact, and convenient to handle.

What is claimed is:

1. In a boot carrier for ski boots, said ski boots being a right and left boot, each of said boots having:

a. a heel and a toe, b. a flat rigid sole, c. a toe notch across the toe for ski bindings, and d. a heel notch across the heel for ski bindings;

wherein the improved carrier comprises:

a unitary, contoured heel frame adapted to fit closely around the backs of both of the heels of a pair of ski boots, said heel frame including contoured cavities generally conforming to the respective back portions of the heels of a pair of ski boots when placed side-by-side in a normally upright position with the backs of the heels nesting in said heel frame flexible tensioning means extending from said contoured heel frame for retaining said ski boots received in said heel frame; and a support means comprising a rod-like, rigid member extending from the mid portion of said contoured heel frame at a small angle from the vertical, toward the front of said boots for supporting the heel frame and ski boots for supporting the heel frame and ski boots received in said heel frame.

2. The boot carrier of claim 1, wherein the flexible tensioning means comprises a single elastic cord connected at its ends to the respective ends of said heel frame.

3. The boot carrier of claim 2, including a U-shaped member adapted to be inserted in the tops of the respective boots to provide additional stability to the boots being carried.

4. The boot carrier of claim 1, in which the heel frame comprises a pair of bow-like members adapted to conform to the respective backs of the heels of a pair of boots, and including hinge means at the mid-point of said heel frame between said bow-like members which allows the boot carrier to collapse into a small, compact package when removed from a pair of boots.

5. The heel frame of claim 1, in which the contoured cavities have lip portions adapted to fit over the back horizontal edges of the ski boots for added stability, and including means disposed at the mid-portion of said heel frame for receiving the rod-like, rigid member extending from the mid-portion of said heel frame.

6. The boot carrier of claim 1, in which the rod-like rigid member comprises a plurality of telescoping tubular members, and is adapted to telescope to a lesser length for storage.

7. The boot carrier of claim 1, in which the rod-like, rigid member includes a folding end extension, which may be extended substantially horizontally above the boots for stable carrying of the boots in said upright position.

8. A boot carrier comprising:

a unitary, contoured heel frame adapted to fit closely around the backs of both of the heels of a pair of boots having soles; a unitary, contoured toe frame adapted to be disposed around the front of both of the toes of a pair of boots having soles; a vertically extendable carrying handle connected to the heel frame and extending vertically upward between the boots; and elastic tensioning means connected to, and extending between, said heel frame and toe frame, in which the elastic tensioning means extends forwardly from, and connects to, the center of the heel frame and to the center of the toe frame and is disposed between the lower insides of a pair of boots when in use carrying boots.

9. The boot carrier of claim 8, in which the elastic tensioning means comprises a pair of parallel elastic cords which cooperate with the heel and toe frames to firmly hold the boots being carried in side by side relationship having the boot soles in a substantially horizontal plane.

10. The boot carrier of claim 8, in which the carrying handle is a telescoping, tubular member which can be collapsed when not in use on boots.

* * * * *